United States Patent [19]

Shiina

[11] Patent Number: 4,990,118

[45] Date of Patent: Feb. 5, 1991

[54] TOY UTILIZING BUBBLES IN LIQUID

[75] Inventor: Akio Shiina, Toyama, Japan

[73] Assignee: Sente Creations Co., Ltd., Tokyo, Japan

[21] Appl. No.: 344,596

[22] Filed: Apr. 28, 1989

[30] Foreign Application Priority Data

Jul. 19, 1988 [JP] Japan ..... 63-95431

[51] Int. Cl.[5] ..... A63H 29/10; A63H 23/00

[52] U.S. Cl. ..... 446/197; 446/153; 273/1 L

[58] Field of Search ..... 446/197, 198, 199, 267, 446/153, 154, 155, 156, 157, 158; 273/1 L; 220/373

[56] References Cited

U.S. PATENT DOCUMENTS

| | | | |
|---|---|---|---|
| 2,298,938 | 10/1942 | Griffin, Jr. et al. | 220/373 |
| 2,590,279 | 3/1952 | Soss | 446/198 X |
| 2,836,927 | 6/1958 | Warner | 446/155 |
| 3,009,286 | 11/1961 | Warner | 446/153 |
| 3,253,354 | 5/1966 | Gollner et al. | 446/153 X |
| 3,335,897 | 8/1967 | Castro | 220/373 |
| 3,507,708 | 4/1970 | Vignano | 220/373 X |
| 3,733,738 | 5/1973 | Kramer | 273/1 L X |
| 3,773,015 | 11/1973 | Cruickshank et al. | 446/153 X |
| 4,032,141 | 6/1977 | Tanimura | 446/197 X |
| 4,122,627 | 10/1978 | Kubiatowicz | 446/156 |
| 4,165,816 | 8/1979 | Tupper | 220/373 X |
| 4,294,895 | 10/1981 | Atkins | 220/373 X |
| 4,568,322 | 4/1986 | Henderson | 446/197 X |
| 4,778,429 | 10/1988 | Todokoro | 446/153 |
| 4,923,429 | 5/1990 | Lewis | 446/197 |

FOREIGN PATENT DOCUMENTS

| | | | |
|---|---|---|---|
| 1076803 | 5/1980 | Canada | 446/153 |

*Primary Examiner*—Robert A. Hafer
*Assistant Examiner*—D. Neal Muir
*Attorney, Agent, or Firm*—Waldron & Associates

[57] ABSTRACT

A toy utilizing bubbles in liquid comprises a vessel to be charged with a liquid keeping an air layer at the top and to be sealed, a bubble generating member, and in-liquid movable members moved by bubbles rising in the liquid in the vessel.

7 Claims, 10 Drawing Sheets

TOY UTILIZING BUBBLES IN LIQUID

BACKGROUND OF THE INVENTION

1. Field of the Invention

The present invention relates to a toy utilizing bubbles in liquid, and more specifically it relates to a novel toy by which a game is enjoyed by generating bubbles and controlling various in-liquid movable members by the buoyancy of the bubbles.

2. Prior Art

As a conventional game machine by which in-water movable members are controlled, a quoit game by which pins are set up in a water tank in which rings and water are confined and water stream is generated by shaking the water tank to put the rings into the pins with luck has been known, and as a game developing the above-mentioned one, for example, Japanese Utility Model Publication No. 312/79 discloses an in-water moving game by which a game is enjoyed by generating water stream in the water tank by pushing operation with a finger, whereby the in-water movable members are transferred.

However, since in the conventional in-water moving game, the in-water movable members are transferred by water stream, it is necessary for controlling the in-water movable member satisfactorily to control the water stream freely. But the movement of the water stream is scarcely visible. Therefore, it is difficult to control the water stream satisfactorily, and the game is made difficult consequently, which brings about pleasure in one aspect, while the game is easily tired of because the game is characterized by only controlling with a human finger and is unsatisfactory in vision.

The present invention has been accomplished taking consideration of such problems.

SUMMARY OF THE INVENTION

An object of the present invention is to provide a toy by which bubbles are generated in a vessel confining a liquid and in-liquid movable members are moved by the bubbles rising in the vessel, in which the generation of bubbles can be controlled by outer operation, thereby a game more visually entertaining can be played.

According to the present invention, there is provided a toy utilizing bubbles in liquid, comprising a vessel to be charged with a liquid keeping an air layer at the top and to be sealed, a bubble generating means, and in-liquid movable members moved by bubbles rising in the liquid in the vessel.

The bubble generating means comprises a bubble generating opening formed in the bottom of the vessel, an air-permeable member disposed under the bubble generating opening, and an air compressing member for sending air into the air-permeable member. It is preferable to generate bubbles into the vessel by pushing the air compressing member.

It is also preferable to provide an air suction pipe for sending air in the sealed vessel to the air compressing member, the air suction pipe being attached at the upper end with a check valve for preventing the liquid in the vessel from flowing into the air compressing member.

It is also allowable that the upper face of the sealed vessel is provided with a filter having a permeability of only air, while the air compressing member is provided with an air intake vent for taking in air from outside.

Further, it is preferable to provide a guide rib for leading or dividing the movable members controlled by bubbles rising in the liquid.

The movable member moving in liquid has a shape of an upside-down bowl to catch and retain the bubbles, and when a bubble separating member is provided in the upper portion of the vessel, the movable member can float or sink in the liquid.

As to the toy of the present invention, when a player operates the bubble generating means, bubbles are generated in a liquid in the vessel and ascend therein. When the bubbles can successfully come into contact with movable members in the vessel, the movable members are transferred in the liquid and some of them are pushed upwards, so various games can be played utilizing these phenomena.

Further, when the ascended movable member hits against bubble separating member to lose bubbles, it descends again. The in-liquid movable member can be made of, for example, a synthetic resin having a little larger specific gravity than that of the liquid.

Moreover, when guide ribs are provided in the vessel, the ascending bubbles and the in-liquid movable members can be led or divided thereby.

DETAILED DESCRIPTION OF THE PREFERRED EMBODIMENT OF THE INVENTION

Figure 1:
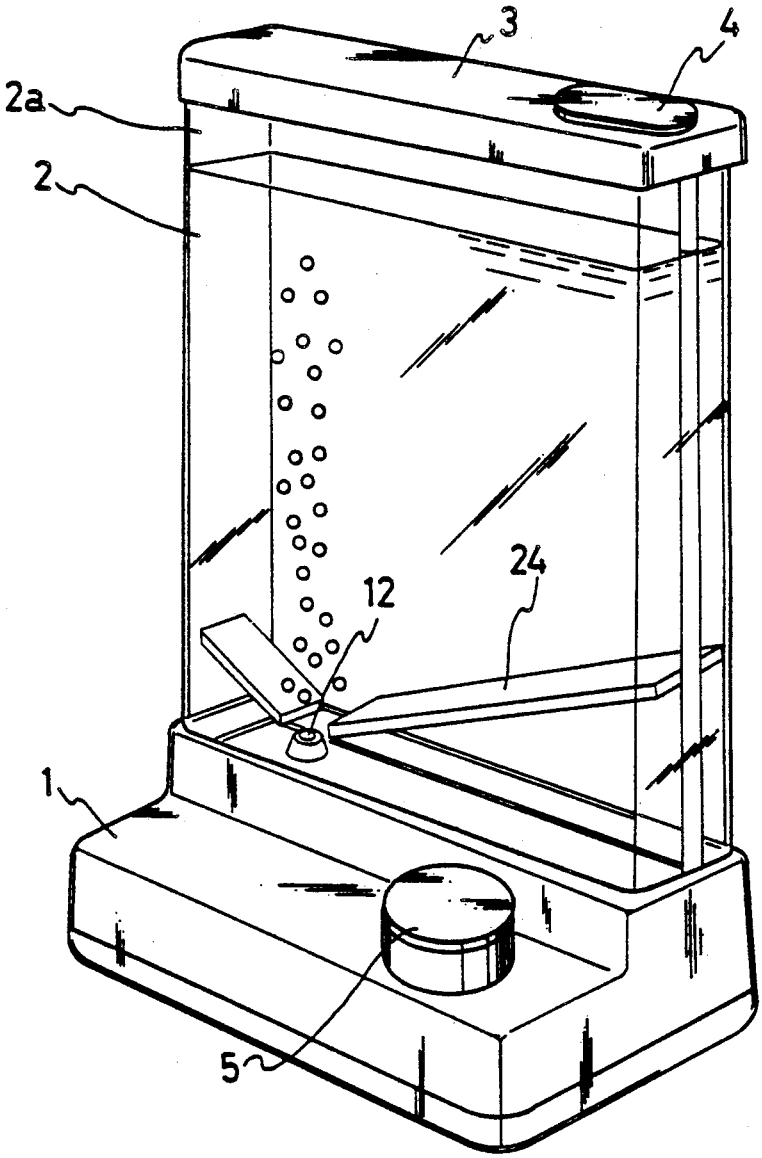
FIG. 1 is a perspective view showing an appearance of an embodiment of the present invention.
Figure 2:
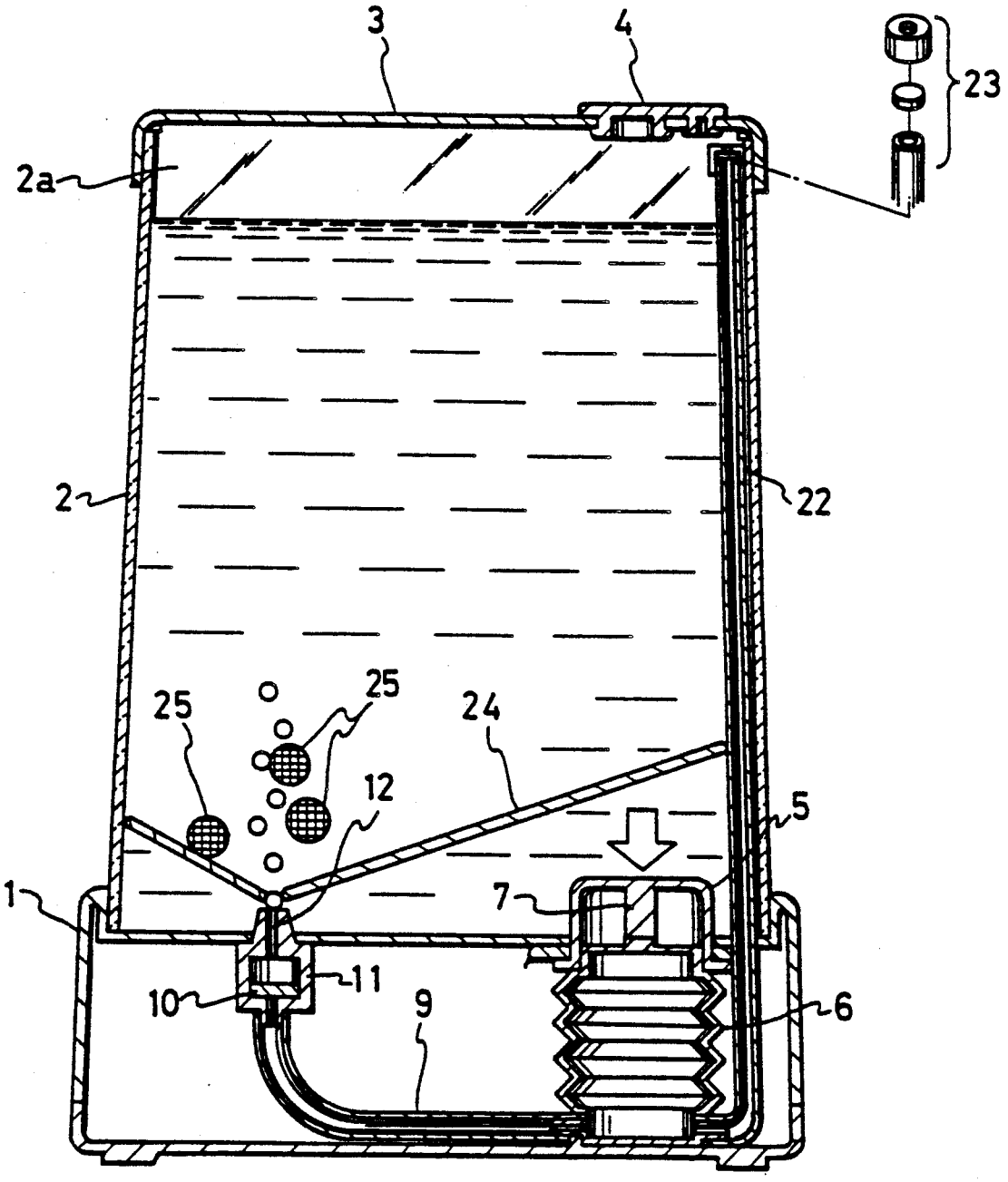
FIG. 2 is a sectional view showing the inner structure of the embodiment of FIG. 1.

FIG. 1 is a perspective view illustrating an embodiment of the present invention, and FIG. 2 is a sectional view showing the inner structure.

The toy shown in the drawings has a transparent vessel 2 disposed on a base 1. The vessel 2 is charged with water leaving an air phase 2*a* corresponding to, for example, about one tenth of whole capacity in the upper portion and then covered and sealed with a lid 3 over the upper face. The lid 3 has a cap 4 for closing a water inlet detachably attached on near one end.

The front side of the base 1 is formed lowered by one step, on the right position of which a push button 5 is disposed. The push button 5 comprises a hollow member having a hat-like shape, and attached on an air compressing member 6 formed as a bellows as shown in FIG. 2 and usually extends upwards from the base 1. In this embodiment, a cylindrical projection 7 stretches downwards from the center of the inside upper face of the push button 5 so as to push the air compressing member 6.

The air compressing member 6 is connected at lower end to an end of an air introducing pipe 9, while the other end of the air introducing pipe 9 is connected to the lower end of a cylinder portion 11 extending from under on the bottom of the vessel 2. The cylinder portion 11 has a bubble generating opening 12 formed at the upper end, under which a filter composed of an air permeable but water impermeable fabric member (for example, a nonwoven fabric) is disposed. The filter 10 prevents the water from flowing into the air compressing member 6.

An air intake pipe 22 passes through the base 1 from the upper portion in the vessel 2 to reach the bottom of the air compressing member 6 and is connected thereto at the position other than the position where the air introducing pipe 9 is connected. The air intake pipe 22 has a check valve 23 disposed at the upper end to prevent the water in the vessel 2 from flowing into the air intake pipe 22.

As constructed as above, when the push button 5 is pushed by a finger, the air compressing member 6 is compressed and the air pushed out of the inside thereof is sent into the cylindrical portion 11 through the filter 10 and appears as bubbles in the vessel 2 from the bubble generating opening 12. When the bubbles reach the air phase at the upper portion of the vessel 2, since the vessel 2 is sealed with the cap 4, the inside of the vessel 2 is made into increased pressure. The air in the upper portion of the vessel 2 is sucked into the air intake pipe 22 from the check valve 23 and introduced into the air compressing member 6. Thus, the air pressure in the vessel is maintained normal.

Figure 3:
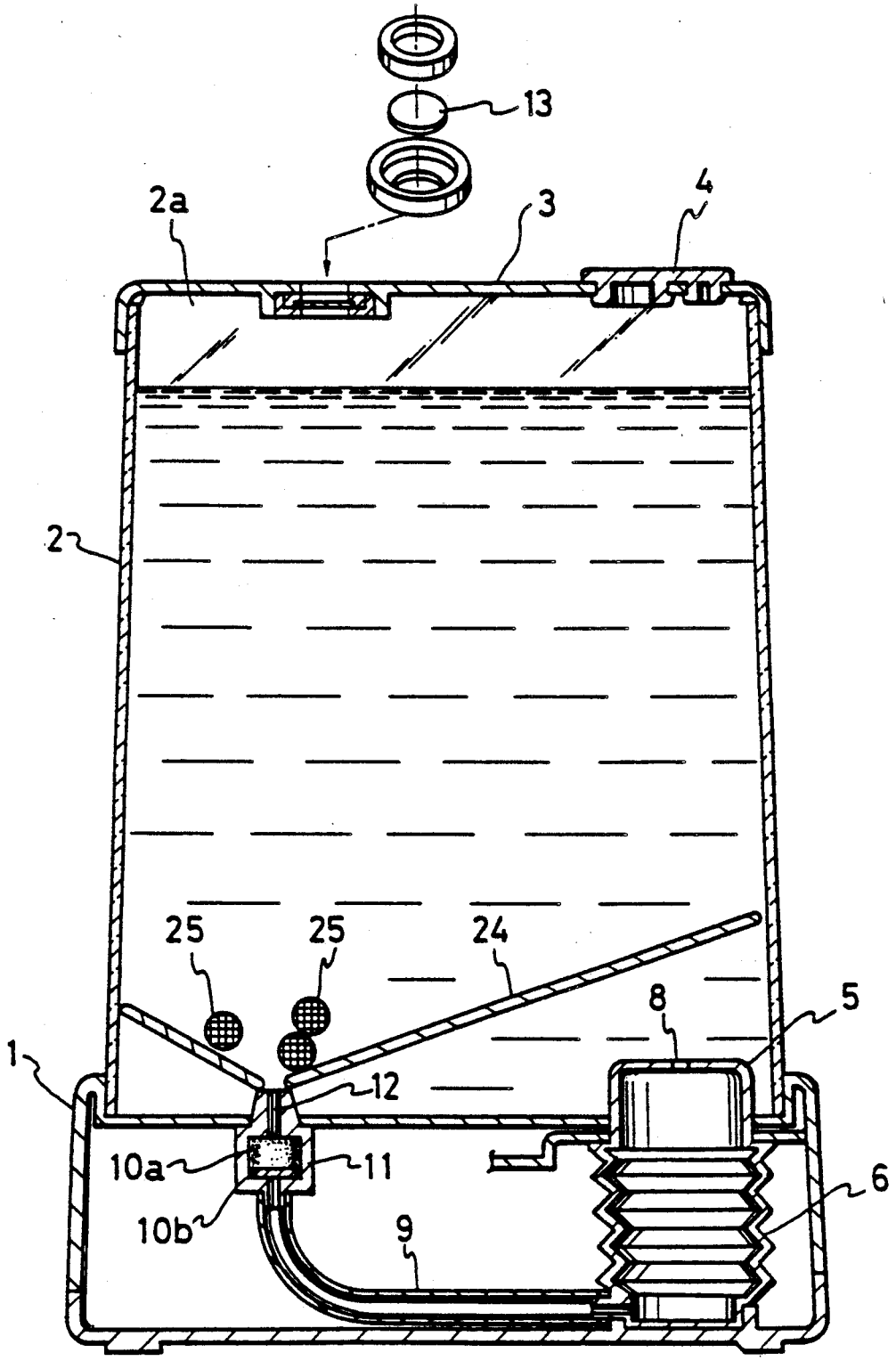
FIG. 3 is a sectional view showing an inner structure of another embodiment.

Next, FIG. 3 shows another embodiment different in structure of the bubble generating means. This case lacks the air intake pipe 22 of FIG. 1, and only air introducing pipe 9 is connected to the lower end of the air compressing member 6.

The push button 5 and the air compressing member 6 are formed as one body as shown in FIG. 3, resulting in a structure capable of being easily manufactured. In this case, an air intake vent 8 is provided in the upper face of the push button 5. In the cylindrical portion 11, instead of the above-mentioned filter 10, an air permeable member **10*a* such as a foamed polyurethane material and a thin film member 10*b* having air and water impermeability such as a silicone rubber film are disposed up and down. It is preferable that the diameter of the thin film member 10*b* is a little smaller than the inside diameter of the cylindrical portion 11** so as to move up and down a little.

On the other hand, the lid 3 has a filter 13 composed of the same material as of the above mentioned filter 10 attached at the position in the opposite side to the cap 4. This filter 13 is attached to the lid 3 placed between a pair of upper and lower ring members and serves for preventing the pressure from increasing by the air permeability thereof and also for preventing the water from flowing out when the vessel falls down.

Figure 4A:
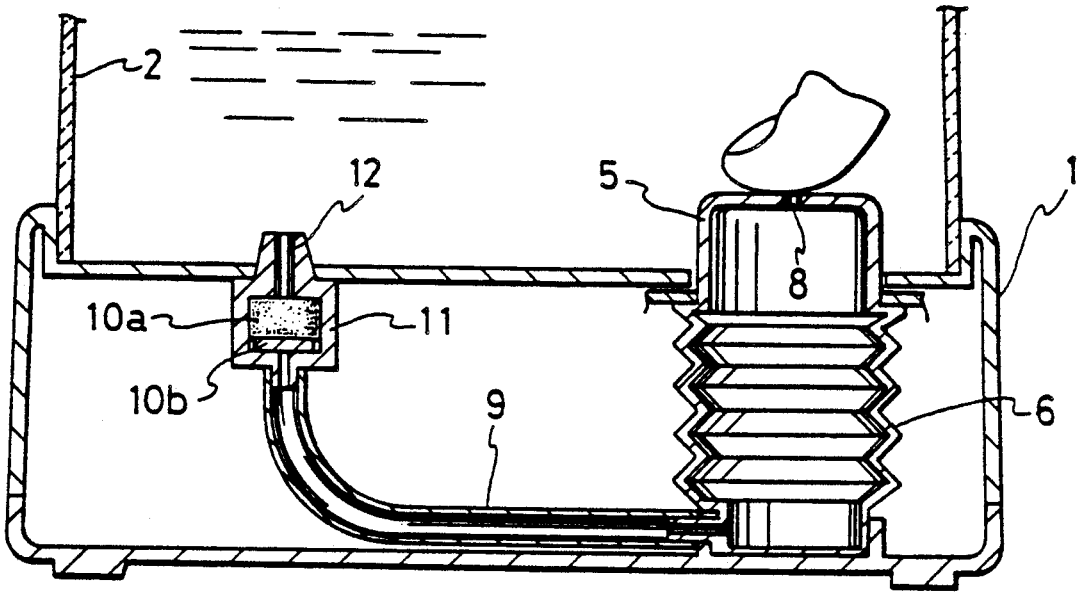
FIGS. 4*a* and *b* sectional views showing function of a bubble generating means.
Figure 4B:
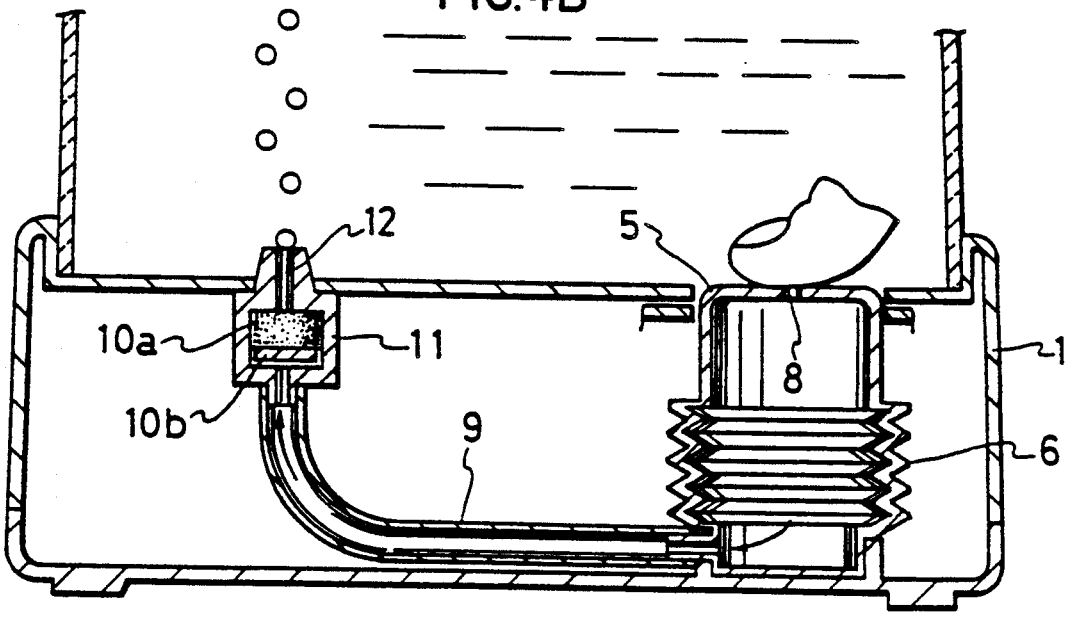

In this embodiment, as shown in FIG. 4(A), by closing and pushing the air intake vent 8 of the push button 5 by a finger, the volume within air compressing member 6 is compressed and the air pushed out is sent to the cylindrical portion 11 through the introducing pipe 9. As a result, as shown in FIG. 4(B), the thin film member **10*b* in the cylindrical portion 11 is pushed up to form a gap around it, through which the pressurized air enters the air permeable member 10*a* passes through it to emerge as bubbles from the bubble generating opening 12 into the vessel 2. When the finger is detached from the push button 5, the push button 5 formed in one body with the air compressing member 6 is stretched upwards due to elasticity of the bellows and returns to the original position. At this time, air is sucked through the air intake vent 8 of the push button 5 into the air compressing member 6**.

Figure 5:
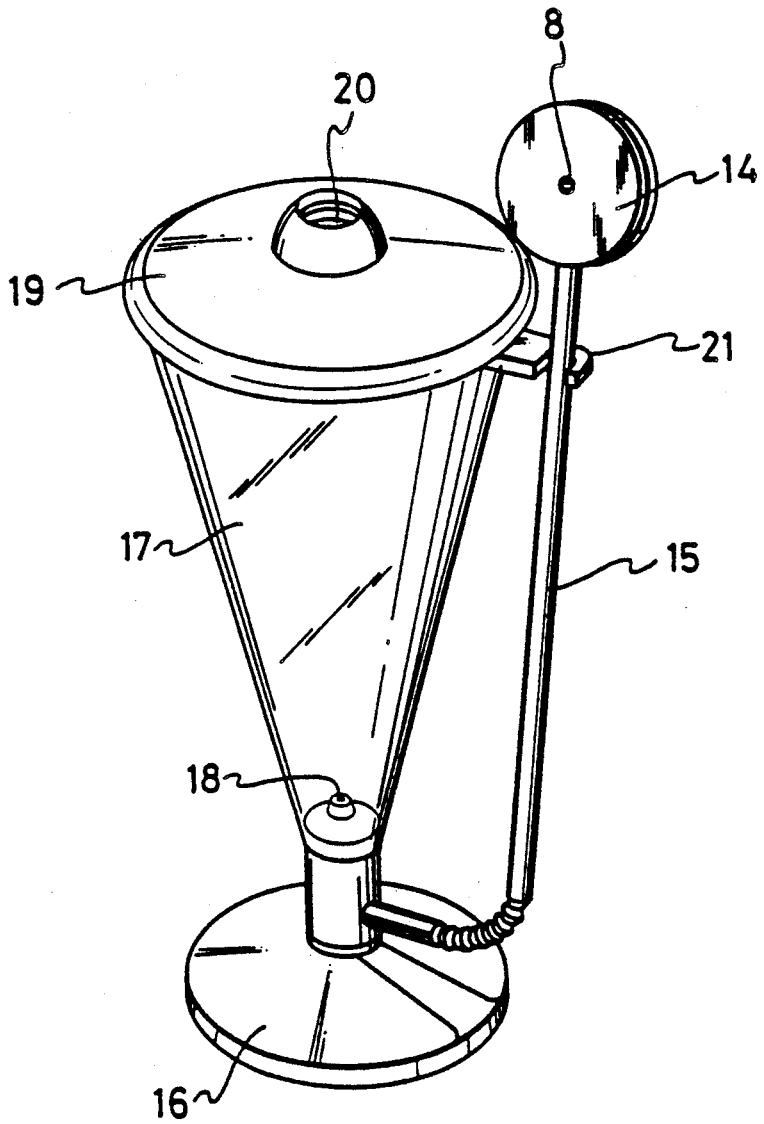
FIG. 5 is a perspective view showing another embodiment.

The air compressing member can be provided separately from the base. For example, as shown in FIG. 5, to an air compressing member 14 composed of a hollow rubber bellows having an air intake vent 8 connected to an air sending pipe 15 having a bellows-like bendable portion, by which air may be sent to a bubble generating opening 18 in a vessel 17 filled with water through a check valve (not shown) set in a base 16. The vessel 17 is freely detachably fixed at the top with a lid 19, at the center of which is disposed a filter 20 serving in the same manner as the filter 13 mentioned above.

In operation, the air sending pipe 15 may be taken off from a hook 21 extruding from the side face of the vessel 17 and the air compressing member 14 may be placed at a desired position and pushed by a finger.

The in-liquid movable member is explained below.

As shown in FIGS. 2 and 3, a plurality of ball-like in-water movable members 25 having a specific gravity larger than 1 are accommodated in the vessel 2. Each of the movable members 25 is led over the bubble generating opening by almost V-shaped guide ribs 24 disposed in the bottom of the vessel 2, and is energized by the bubbles and pushed upwards in the water to act variously.

Figure 6:
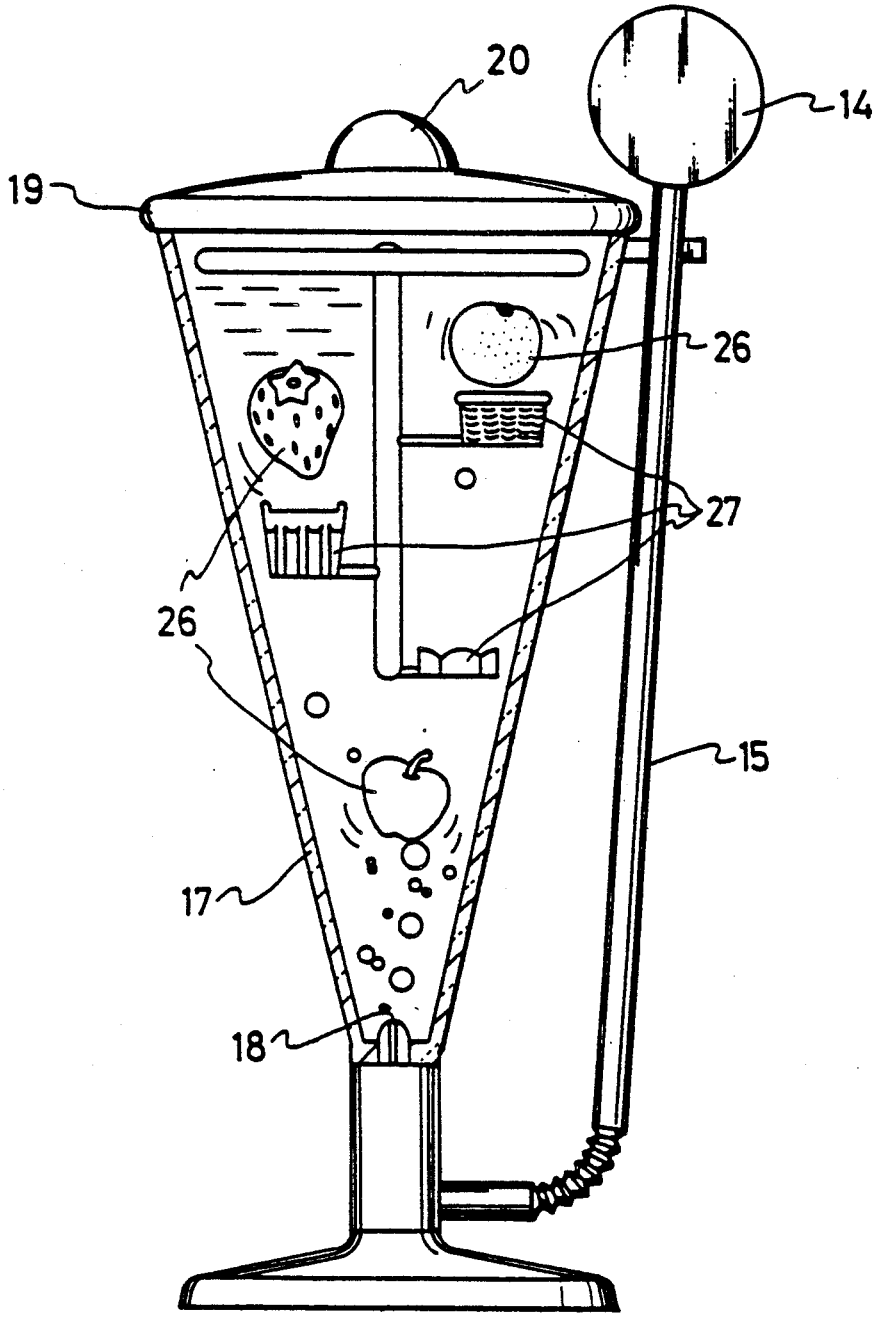
FIGS. 6 and 7 are views showing embodiments accommodating different in-liquid movable members, respectively.

As shown in FIG. 6, if in-water movable members imitating various fruits are associated with receptors 27 provided in a vessel 17, a game can be enjoyed that the movable members are energized in the water by bubbles weakly or strongly generated and are put on the receptors. In order to return them to the original positions, the vessel 17 may be shaken by a hand to cause the in-water movable members 26 to fall from the receptors 27.

Furthermore, when the movable member has a structure to which bubbles can easily be attached, the movable member can be raised in water by buoyancy of bubbles attached to the movable member. Also, if a pin-like bubble separating member extruding in the vessel 17 under the surface of the water are provided instead of the receptor 27, an ascended in-water movable member 26 hits against it to separate the bubbles retained within the movable member, thereby the movable member 26 begins to fall again.

Figure 7:
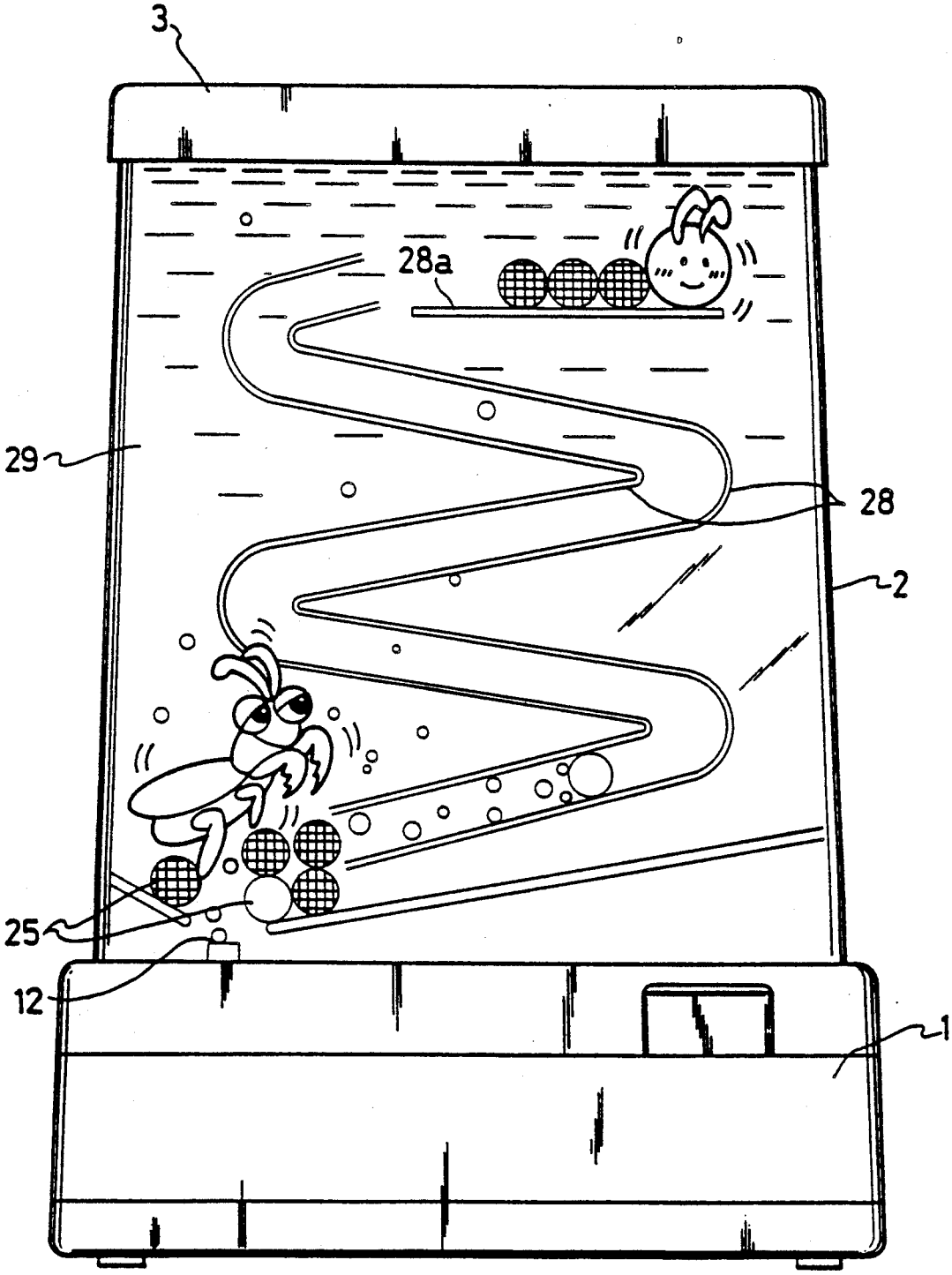

FIG. 7 shows an embodiment in which water-movable member is transferred in a long distance.

A back plate 29 in the vessel 2 has a pair of parallel guide ribs 28 extruding frontwards having an interval and a height of a little larger than the diameter of ball-like in-water movable members 25 which are made as a zigzag course. The in-water movable members are energized by bubbles to enter between the guide ribs 28, pushed up along the guide ribs 28 by bubbles and finally reach goal **28*a***. Thus, a game to compete how many balls can enter a goal in a certain period can be played.

Figure 8A:
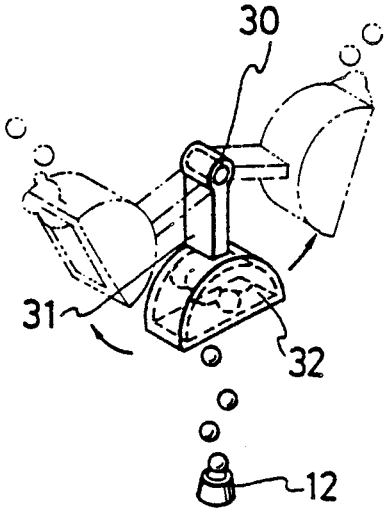
FIGS. 8*a* and *b* and 9*a* and *b* and 10*a*, *b* and *c* views showing various examples of the in-liquid movable members.
Figure 8B:
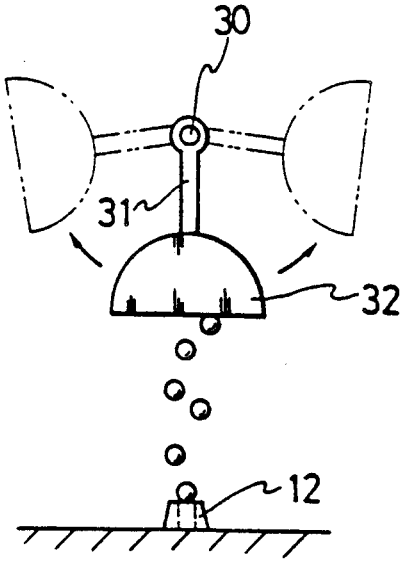

FIGS. 8(A) and (B) show an example of movable member which swings in water. This movable member 31 is freely rotatively attached to an axle 30 extending from the inner wall of the vessel 2, and has a bowl-like cap 32 in the opposite side to the axle 30. The cap 32 is normally suspended upside down from axle 30. When bubbles are generated from the bubble generating opening 12 positioned beneath, bubbles are retained in the cap 32 and due to buoyancy of the bubbles, the movable member 31 is moved rotatively right or left with the axis 30 as the center, stopped at the position where air in the cap 32 is released, and then returns to the normal position. This action is repeated during continuous generation of bubbles.

Figure 9A:
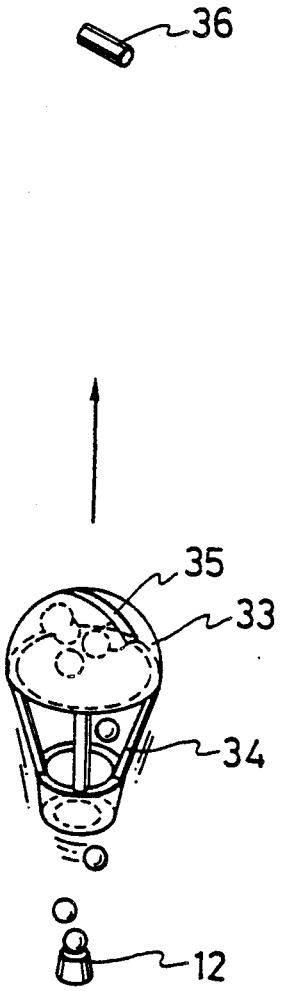
Figure 9B:
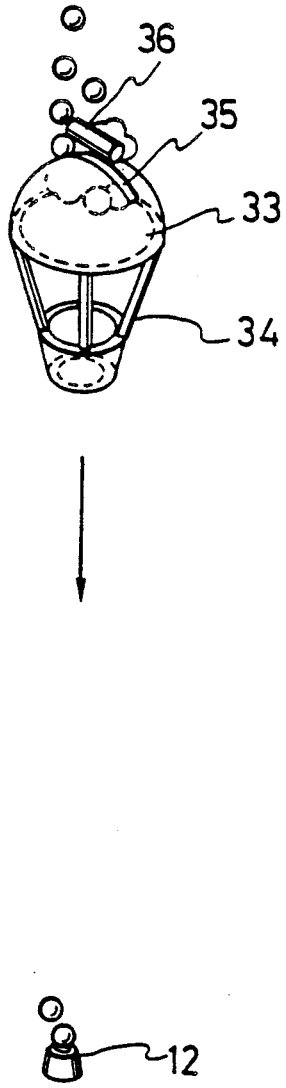

FIGS. 9(A) and (B) show an example of movable member which ascends and descends in water.

This movable member 34 is shaped into a parachute having an upside-down bowl-like cap 33 at upper part. When bubbles are retained in the cap 33, the movable member 34 is lifted due to buoyancy of the bubbles. The cap 33 has a slit 35 at the upper part, and when the ascended movable member 34 hits against a pin-like bubble separating member 36 extending to the inside of a vessel 2, air in the cap 33 is released by the shock through the slit, thereby the movable member 34 descends.

Figure 10C:
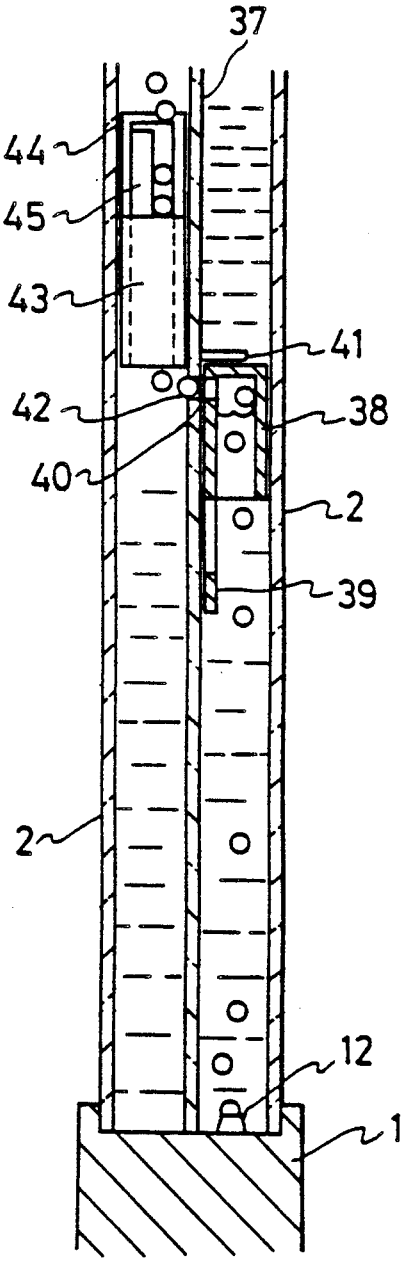
Figure 10A:
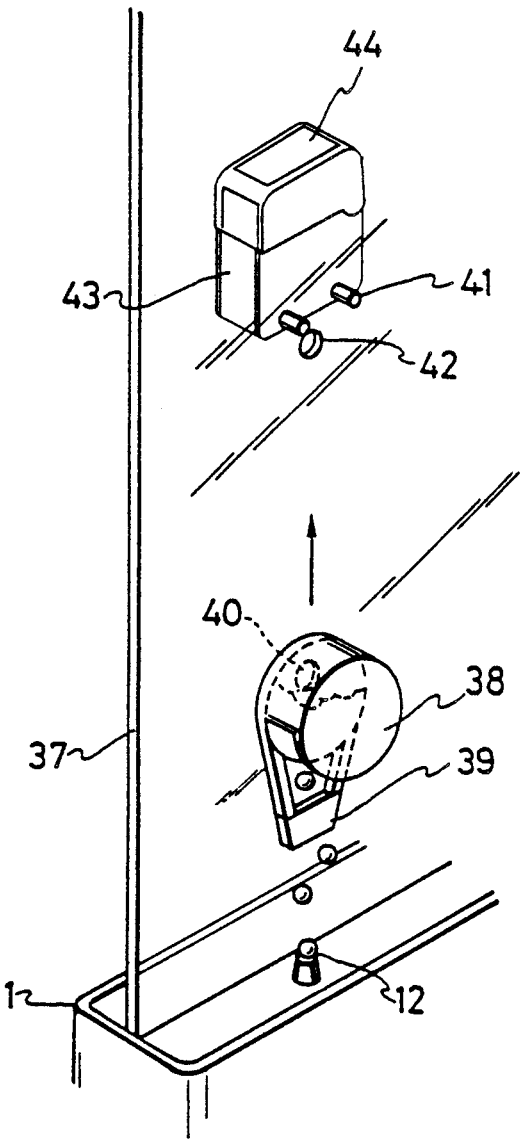

FIG. 10 shows an example in which a factor of toy is added to the action.

Figure 10B:
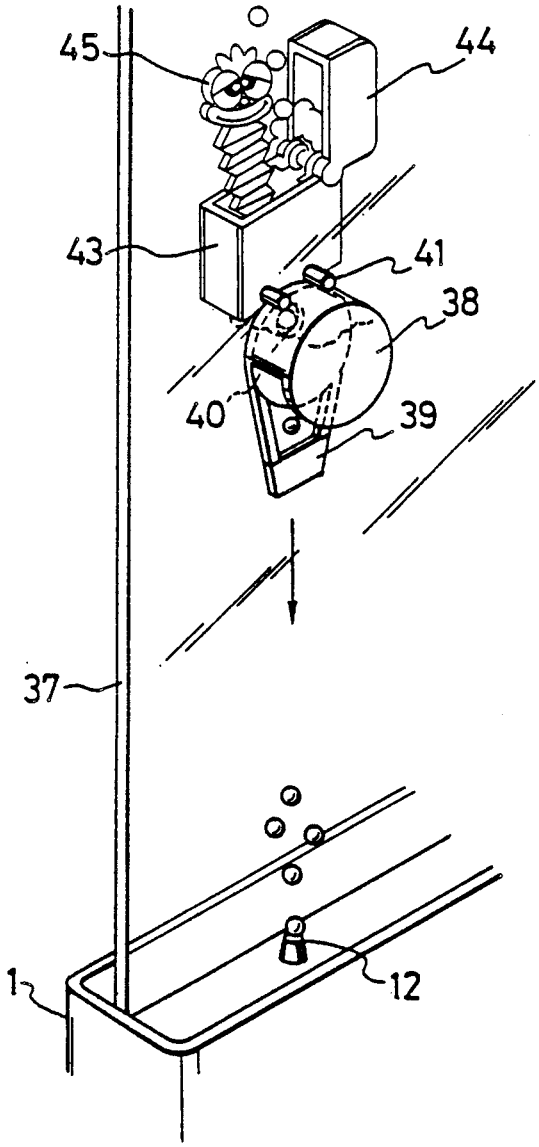

A vessel 2 is divided by a panel 37 into front and rear parts. A movable member 39 shaped as a parachute having a cap 38 like an upside-down bowl ascends and descends in front of the panel on the same theory as mentioned above. Through the cap 38 has a perforation 40 in the upper portion, air stored in the cap 38 is not released because during the movement the perforation 40 is closed by the panel 37. At the position where the in-water movable member 39 ascends from the position of FIG. 10(A) and hits against a pin 41 extending from the panel 37 as shown in FIGS. 10(B) and (C) and is stopped, a perforation 42 is formed in the panel 37 corresponding to the perforation 40. Therefore, the air in the cap 38 is released through these perforations 40 and 42, thereby the movable member 39 loses buoyancy and falls.

On the other hand, the released air is introduced into a bottom opening of a jack-in-the-box 43 provided on rear face of the panel 37 and reaches a lid 44, pushes and opens the lid by the buoyancy to make a figurine 45 jump out and then gets out along the opened lid 44. The lid 44 is closed again.

The toys having specific bubble generating means and in-liquid movable members have been explained in above as embodiments or examples. The combination thereof can be selected optionally. As the liquid, a non-volatile solvent such as ethylene glycol, polyethylene glycol, etc. may be used as well as water. Two or more push buttons may also be provided for one bubble utilizing toy, or in-liquid movable members having different specific gravities may also be provided. As mentioned above, since the in-liquid movable member can be moved at will by controlling the generation of bubbles according to the present invention, the actions which conventional in-water moving toys are lacking in can be enjoyed in addition of visually joyful movement of bubbles.

What is claimed is:

1. A toy utilizing bubbles in liquid, comprising at least one in-liquid movable member, a transparent sealed vessel adapted to contain a liquid and said in-liquid movable member, said vessel having a lower portion, an upper portion and an opening adapted to permit introduction of said liquid into said vessel, such that a volume of air will remain in the upper portion of said sealed vessel, a lid for closing said opening to seal said vessel, a bubble generating means adapted to manually introduce air into said sealed vessel through a bubble generating opening in the lower portion of said vessel thereby creating air bubbles which will ascend through said liquid, which bubbles are capable of engaging and moving said in-liquid moveable member, whereby the air from said bubbles will be collected in said volume of air remaining in the upper portion of said sealed vessel, and an air suction pipe for permitting air to travel from said volume of air in the upper portion of said sealed vessel to said bubble generating means, said air suction pipe having a check valve adapted to prevent the liquid in said vessel from flowing into said air suction pipe.

2. A toy according to claim 1, wherein said means for permitting air to egress from said volume of air comprises a filter through which air is permeable but said liquid is impermeable and adopted to permit air to egress from said sealed vessel, and said bubble generating means has an air intake vent for taking in air from outside of said sealed vessel.

3. A toy according to claim 1 wherein said vessel is provided with guide ribs for controlling the movement of said in-liquid moveable member put in motion by the bubbles rising in the liquid.

4. A toy according to claim 1 wherein said vessel is provided with a bubble separation member adapted to separate bubbles from engagement with said in-liquid moveable member when said in-liquid moveable member contacts said bubble separating members so that said in-liquid moveable member will sink to the bottom of said vessel.

5. A toy according to claim 1 wherein at least a portion of said in-liquid moveable member has a recess in the shape of an upside-down bowl having a center of gravity below said recess and is adapted to move by retaining bubbles in the recess portion.

6. A toy according to claim 1 in which said bubble generating means comprises a manually operated air compressing member.

7. A toy according to claim 1 wherein said bubble generating opening is provided with a filter permeable to air but impermeable to said liquid to prevent the liquid in said vessel from flowing into said bubble generating opening.

* * * * *